United States Patent [19]

Jordan

[11] 3,946,683

[45] Mar. 30, 1976

[54] TABLESS CONTAINER OPENING DEVICE AND METHOD AND TOOLS FOR FORMING THE SAME

[75] Inventor: Charles L. Jordan, Pittsburgh, Pa.

[73] Assignee: Aluminum Company of America, Pittsburgh, Pa.

[22] Filed: May 2, 1974

[21] Appl. No.: 466,405

Related U.S. Application Data

[63] Continuation-in-part of Ser. No. 318,476, Dec. 26, 1972, abandoned.

[52] U.S. Cl. ..... 113/15 A; 113/121 C

[51] Int. Cl.[2] ..... B21D 51/40

[58] Field of Search ..... 113/15 R, 15 A, 121 C, 113/1 F; 220/266, 268, 276

[56] References Cited

UNITED STATES PATENTS

| | | | |
|---|---|---|---|
| 3,227,304 | 1/1966 | Asbury | 220/268 |
| 3,406,866 | 10/1968 | Jasper | 220/270 |
| 3,426,714 | 2/1969 | Boik et al. | 113/121 C |
| 3,576,272 | 4/1971 | Colby | 220/270 |
| 3,610,463 | 10/1971 | Brown | 220/270 |
| 3,687,099 | 8/1972 | Franek | 113/121 C |
| 3,715,052 | 2/1973 | Kinkel | 220/270 |
| 3,848,557 | 11/1974 | Holk, Jr. | 113/121 C |

FOREIGN PATENTS OR APPLICATIONS

| | | | |
|---|---|---|---|
| 1,164,179 | 10/1966 | United Kingdom | 113/15 A |
| 44,198 | 7/1927 | Norway | 113/15 A |

*Primary Examiner*—Lowell A. Larson
*Attorney, Agent, or Firm*—David W. Brownlee

[57] ABSTRACT

A tabless container opening device of work hardened metal having at least one substantially rigid inwardly displaceable opening panel bounded by a weakening line which includes a fracturable web and having an outwardly projecting deflectable portion in the container wall adjacent the weakening line around the opening panel is formed between first and second die members which displace metal in a container wall to form the weakening line and additionally coin the container wall along a zone adjacent one side of the weakening line.

8 Claims, 8 Drawing Figures

TABLESS CONTAINER OPENING DEVICE AND METHOD AND TOOLS FOR FORMING THE SAME

REFERENCE TO RELATED APPLICATION

This is a continuation-in-part of my U.S. application Ser. No. 318,476, filed Dec. 26, 1972 for Tabless Container Opening Device and Method and Tools for Forming the Same, now abandoned.

BACKGROUND OF THE INVENTION

1. Field of the Invention

This invention relates to containers and container ends, and in particular to a tabless opening device in a container wall and a method and tools for forming the same.

2. Description of the Prior Art

The problem of litter caused by completely severable tear strips and pull tabs on easy opening cans has resulted in the development of several tabless easy opening devices in which no element is completely severable from the container wall. Disclosures of such tabless opening devices are contained in U.S. Pats. Nos. 3,227,304, 3,246,791, 3,355,058, 3,334,775, 3,362,569 and 3,410,436 among others.

It is known to form a weakening line for such a tabless opening device by displacing metal along one side of a weakening line at right angles to the initially undisplaced surface of a container wall in such a way that the edge defining the periphery of a removable or partially removable wall portion underlaps the corresponding edge of the non-removable wall portion and has an abrupt change in cross-sectional wall thickness as is disclosed in U.S. Pat. No. 3,362,569. It is further known to form a weakening line around a partially removable panel in a container wall by moving metal substantially at right angles to the original surface of the sheet and squeezing a narrow zone of metal along such line to cause lateral flow of material away from the line as is disclosed and claimed in an application for U.S. Letters Patent Ser. No. 357,937, filed May 7, 1973. Although the method and apparatus disclosed in such patent application work well for material having any given thickness, the dies used in such method have sometimes been found to produce defective ends when the sheet material from which they are formed varies in mechanical properties and/or in thickness within commercially accepted ranges. Sheet metal from which container ends are formed may have tolerances of approximately plus or minus 0.0005 inch in aluminum and even more in steel, and such tolerances can cause difficulties in forming weakening lines in the metal using the prior art dies. When such sheet metal is thicker than nominal gauge, the ends produced with prior art dies have sometimes been difficult to open, and when the material is thinner than nominal, the tabless container ends produced from such material have sometimes had cracks or premature failures in the weakening lines.

The prior art is lacking in a method and tools for making tabless easy opening devices which work well on deformable sheet material which varies in thickness within commercially accepted ranges.

SUMMARY OF THE INVENTION

This invention provides a tabless container opening device and tools and a method for forming the same by forming a weakening line defining a substantially rigid inwardly displaceable opening panel, forming an outwardly projecting deflectable portion in the container wall adjacent to the opening panel and to the weakening line therearound, and compressing or coining metal in the container wall along a zone adjacent to the weakening line.

Accordingly, an object of this invention is to provide a method and apparatus for forming a tabless opening device in a container wall.

Another object of the invention is to provide a method and apparatus for forming a weakening line in sheet material having commercially accepted gauge variations.

Another object of the invention is to provide a method and tools for forming a weakening line in a container wall by displacing metal at right angles to the plane of the container wall while squeezing a narrow zone of metal along the weakening line and coining metal adjacent at least one side of the weakening line.

A further object of the invention is to provide a tabless easy opening device which can be formed in sheet metal having commercially accepted gauge variations.

The above and other objects and advantages of the invention will be more fully understood and appreciated with reference to the following description and the drawings attached hereto.

DESCRIPTION OF PREFERRED EMBODIMENTS

Figure 1:
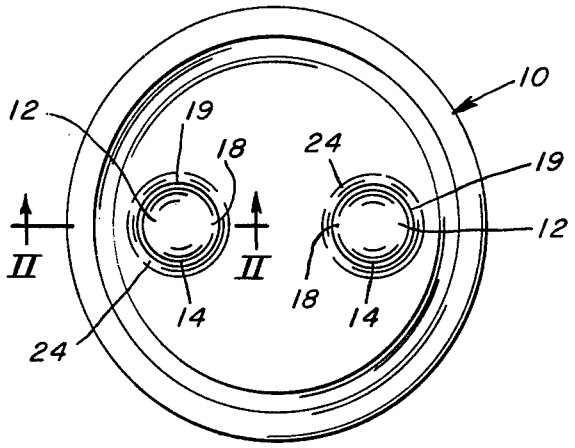
FIG. 1 is a plan view of a can end of the invention.

This invention is an improvement upon the tabless opening device and method of forming the same which are disclosed and claimed in an application for U.S. Letters Patent Ser. No. 357,937, filed May 7, 1973, which is a continuation-in-part of application Ser. No. 281,541, filed Aug. 17, 1972. According to that application and as is illustrated in the drawings attached hereto, a container wall such as a closure or a can end 10 which is made of deformable material, preferably hard temper aluminum alloy, may include at least one, and preferably two, depressible or inwardly displaceable substantially rigid opening panels 12 which are defined by weakening lines 14 in the can end. Panels 12 are designed to be opened by pressing them into a container on which can end 10 is sealed to form a pouring opening and/or a vent in the can end. Weakening lines 14 around panels 12 may be formed by displacing metal at right angles to the initially undisplaced surface of the metal and squeezing a narrow zone of metal along the weakening line to form a relatively thin fracturable web a few thousandths of an inch thick. Each weakening line 14 in the can end may be C-shaped and may have a bridge of metal 18 between the ends of the line providing a hinge which will prevent complete separation of the panels 12 from the container end 10. The hinge 18 between the ends of each weakening line 14 may be slightly weakened by a shallow scoreline or the like, but may also be unweakened for some applications.

In accordance with this invention, a zone of coining 19 is formed in can end 10 adjacent the weakening line 14 around each of the opening panels 12. In the preferred embodiment, each such zone of coining 19 is formed in the outer surface of the can end in the wall portion adjacent the opening panel and spaced from the weakening line around such panel a distance of approximately one to three times the thickness of the metal in the can end. An exemplary zone of coining 19 is best seen in cross section in the container wall 32 illustrated in FIG. 4 wherein the zone of coining is shown in the upper or outer surface of the container wall underlying the coining rib 56 on die 54 which, in conjunction with die 30, has formed such zone of coining.

Figure 2:
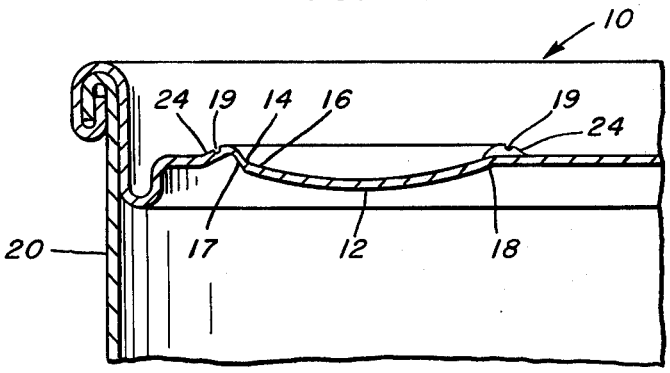
FIG. 2 is an enlarged fragmentary cross section through the can end of FIG. 1 taken along line II—II.

Referring to FIG. 2 it is seen that in one embodiment of this invention, the top surface 16 of panel 12 adjacent weakening line 14 is in approximately the same plane or line-on-line with the bottom surface 17 of metal adjacent the scoreline outside the panel. FIG. 2 further shows an integral flexible bulge or deflectable portion 24 projecting outwardly from the can end adjacent each weakening line. As will be explained, the deflectable portion 24 facilitates depressing of the panel 12 into a can on which end 10 is secured.

According to this invention, the opening panels 12 are preferably substantially rigid and downwardly domed as is illustrated in FIG. 2. Such downwardly domed panels 12 provide maximum resistance to rupture of the weakening lines 14 by high internal pressure in the container 20 on which the end is secured, and also provide maximum ease of rupture of the weakening lines by force applied externally against the can end. Pressure in the container 10 will produce primarily compressive stresses in the residual metal in the weakening line 14 around the downwardly domed panel 12, and the metal can withstand relatively high compressive stresses without failure. But, when external force is applied against the container wall 10 in the area of the weakening line 14, a combination of stresses, including at least some shear stress, will be produced in the residual metal and this combination of stresses will rupture the weakening line.

The fracturable web of residual metal in weakening line 14 around each opening panel 12 is preferably located above or outwardly of the general plane of the container wall 10. When the deflectable portion 24 adjacent the weakening line 14 is depressed or flexed downward under force applied externally against such deflectable portion, relative displacement of the metal on opposite sides of the weakening line will be produced to strain the fracturable web and initiate fracture thereof to permit inward displacement of a partially separated opening panel.

Figure 3:
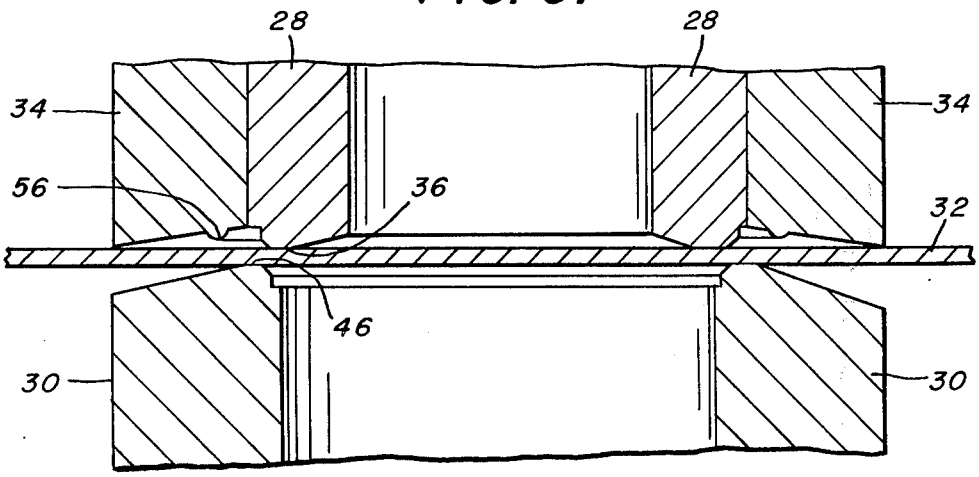
FIG. 3 is a cross section illustrating tools for forming a weakening line in a container wall in accordance with the invention.
Figure 4:
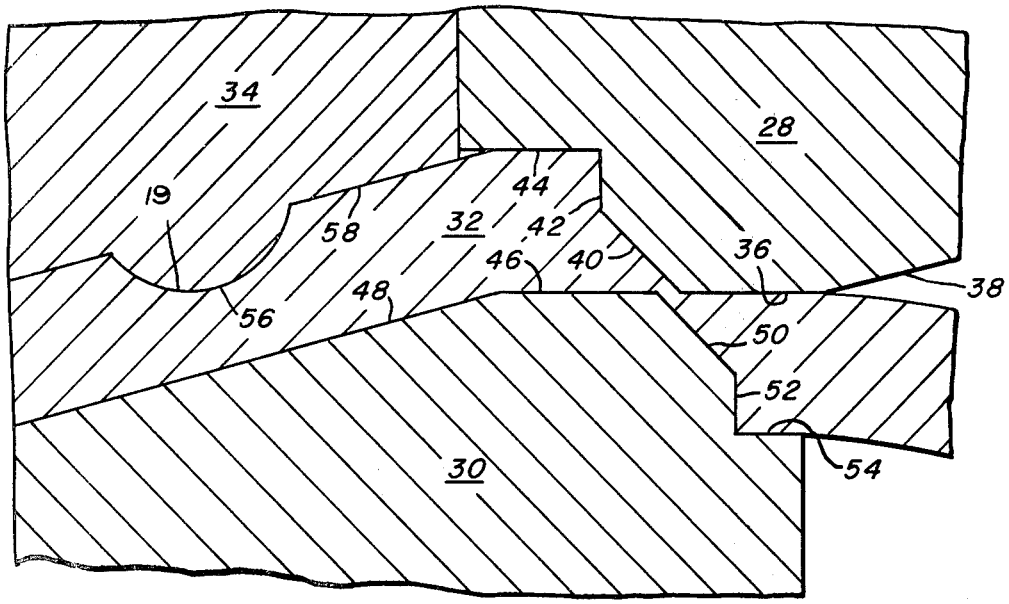
FIG. 4 is an enlarged fragmentary cross section of the tools of FIG. 3.

FIGS. 3 and 4 illustrate an exemplary form of tools for practicing this invention. Such tools comprise a vertically movable annular top die 28 and an annular bottom die 30 between which a metal sheet or container wall 32 can be positioned to have a weakening line formed in it. The tools further include a vertically movable outer annular doming and coining tool 34 for coining the container wall adjacent the weakening line and forming a bulge or deflectable portion in the container wall around the opening panel. Although die 34 is illustrated as being separate from die 28, the two dies may be an integral unit. Referring to FIG. 4, which is an enlargement of the dies 28, 30 and 34 at completion of the forming operation, top die 28 may have a substantially horizontal bottom surface or face 36, an inner face 38 which may be inclined upwardly from face 36 at approximately a 15° angle, an outer face 40 inclined upwardly from the bottom face at approximately a 45° angle, a vertical face 42 extending upwardly from the outer edge of face 40, and a substantially horizontal face 44 extending outwardly from the top of face 42. Bottom die 30 includes a substantially horizontal top surface or face 46, an outer face 48 which may be inclined downwardly and away from top face 46 at approximately a 15° angle, an inner face 50 inclined downwardly from the top face at approximately a 45° angle, a vertical face 52 extending downwardly from the outer edge of face 50, and a substantially horizontal face 54 extending from the bottom of face 52.

Faces 40 and 50 on dies 28 and 30 respectively are substantially parallel and overlap each other in a horizontal plane to cause a relatively narrow zone of metal to be squeezed or extruded laterally from between such faces when the dies are closed against sheet 32. Preferably, such lateral flow or extrusion of metal occurs at approximately a 45° angle to the original undisplaced surface of metal sheet 32, and the horizontal overlap of surfaces 40 and 50 is preferably approximately one-sixth to one-fourth of the thickness of the metal sheet 32. Dies 28 and 30 which have been selected for illustration are so dimensioned that in the closed position of the die faces 36 and 44 on die 28 which oppose faces 46 and 54 on die 30 are vertically spaced a distance of approximately the thickness of sheet 32 to provide a band or zone of relief between the scoring means and the coining means on the dies. The exact spacing of such opposed die surfaces is not considered to be critical to proper functioning of the dies as long as the dies permit the metal in the area between bead 56 on die 34 and side surface 40 on die 28 to flow with little or no restraint. It is believed that face 44 on die 28 and face 58 on die 34 could be spaced a substantial distance above face 36 on die 28, or could be non-existent, and have little if any effect on the functioning of the dies.

It is a feature of this invention that face 40 on die 28 and face 50 on die 30 each have a height in a vertical plane approximately equal to one-half the thickness of the sheet of metal in which the weakening line is formed. Limiting the height of each face 40 and 50 to approximately one-half the thickness of the sheet, in combination with the relief or lack of restraint against the metal in the area between face 40 and bead 56 is believed to minimize the stresses which are produced in the metal during the weakening process, and thereby facilitate the formation of weakening lines in sheet metal which varies in thickness within commercially acceptable ranges.

It is a further feature of this invention that die 34 includes means such as coining bead or rib 56 for coining sheet 32 adjacent the weakening line which is formed by tools 28 and 30. Rib 56 may be arcuate in cross section as illustrated in FIG. 4, or may also have other configurations which will squeeze metal against bottom die 30. Although it is not fully understood, it is believed that coining metal between rib 56 and face 48 on die 30 causes metal to flow laterally from between the rib and die surface to control the stresses which are produced by dies 28 and 30 in forming a weakening line in sheet 32. The height of rib 56 as measured perpendicular to surface 58 on die 34 is preferably in a range of approximately one-quarter to three-quarters of the thickness of sheet 32. Additionally, radii of 0.005 inch, 0.0075 inch and 0.010 inch have been found to work well for rib 56 when forming a weakening line in a hard temper aluminum alloy sheet 0.012 inch thick. Rib 56 is preferably spaced from the weakening line which is formed a distance of approximately one to three times the thickness of sheet 32.

In the operation of dies 28, 30 and 34 to form a weakening line in a container wall or sheet of metal in accordance with this invention, sheet 32 is positioned between the dies as illustrated in FIG. 3, and dies 28 and 34 are closed or moved as a unit toward die 30 to deform the metal sheet therebetween. Faces 36 and 46 on dies 28 and 30 displace or move metal in sheet 32 at substantially right angles to the original undisplaced surface of the sheet to form a line of reduced metal thickness in the sheet. When die surfaces 36 and 46 have closed to within approximately two-thirds to three-fourths of the thickness of sheet 32, metal begins to be extruded or squeezed laterally from between faces 40 and 50 on the dies. This lateral extrusion of metal away from the weakening line which is being formed occurs substantially simultaneously with completion of the displacement of metal at substantially right angles to the original surface of the sheet, and prevents shearing the sheet between the dies. Such lateral flow of metal is preferably approximately at the same rate as the metal is being displaced at right angles to minimize the chances of such metal being sheared or severed by such right angle displacement.

During the formation of a weakening line in sheet 32, rib 56 on die 34 coins metal in a zone adjacent to the weakening line to facilitate forming of such a weakening line in metal sheets which vary from nominal gauge thicknesses. Coining of sheet 32 between rib 56 and die face 48 squeezes or compresses the metal in the sheet causing lateral metal flow away from coining rib 56. Approximately one-half of such metal flow is toward the weakening line which is being formed. It is believed that this lateral flow of metal toward the weakening line in some way controls the stresses in the weakening line which could cause premature or accidental rupture of a weakening line in a sheet which varies from nominal gauge thickness. Coining the sheet along the weakening line permits closing of dies 28 and 30 to a position where faces 36 and 46 are approximately line-on-line with a very thin residual of metal between the dies without forming cracks in the weakening line, even when sheet 32 is thinner than nominal gauge. In the absence of such coining, closing dies of this type to line-on-line of the opposing top and bottom surfaces of the dies could cause undesirable cracks or failures in the weakening lines which are formed.

It is noted that FIG. 4 illustrates coining on one side only of the weakening line which is being formed. It will be apparent to those skilled in the art that such coining could also be effected on both sides of the weakening line or on the side of the weakening line opposite to that illustrated in FIG. 4. It will also be appreciated by those skilled in the art that the coining rib could be provided on bottom die 30 instead of top die 34 and could be of various cross sectional shapes.

In forming a weakening line in sheet 32 with dies 28 and 30, the clearance or relief between faces 42 and 44 on upper die 28 and faces 52 and 54 on bottom die 30 provides space in which metal from sheet 32 can flow as a result of working the metal on either side of such die relief. This further minimizes the stresses which are produced in the sheet during forming of a weakening line in the sheet. Prior to this invention, dies for displacing metal at right angles and extruding metal laterally included side faces similar to faces 40 and 50 of dies 28 and 30, but the faces of the dies extended at approximately a 45° angle for at least the full thickness of the material in which the weakening line was formed. The relief which is provided in dies 28 and 30 in accordance with this invention is believed to reduce the amount of metal flow which is effected by such dies and therefore reduces the stresses which are produced in the metal in the area of the weakening line or score. Reduction in the stresses in such metal is believed to permit the formation of weakening lines having a minimum of residual metal therein for maximum ease of rupture.

In the operation of dies 28, 30 and 34, the depressible panel which is formed will be domed downwardly. Forming a weakening line between the dies increases the surface area of metal in the sheet due to the thinning of metal in the area of the weakening line, and the increased surface area of metal in the panel defined by the weakening line produces the downward dome on the panel. As stated above, such downward dome is preferred for container ends which are to be secured on containers which may have higher-than-atmospheric pressures in them because it provides substantial resistance to rupture of the weakening line by such internal pressures and maximum ease of rupture by external force applied against the can end. It will be apparent to those skilled in the art that an upward dome could also be provided on such depressible panel in container ends for other applications.

Figure 5:
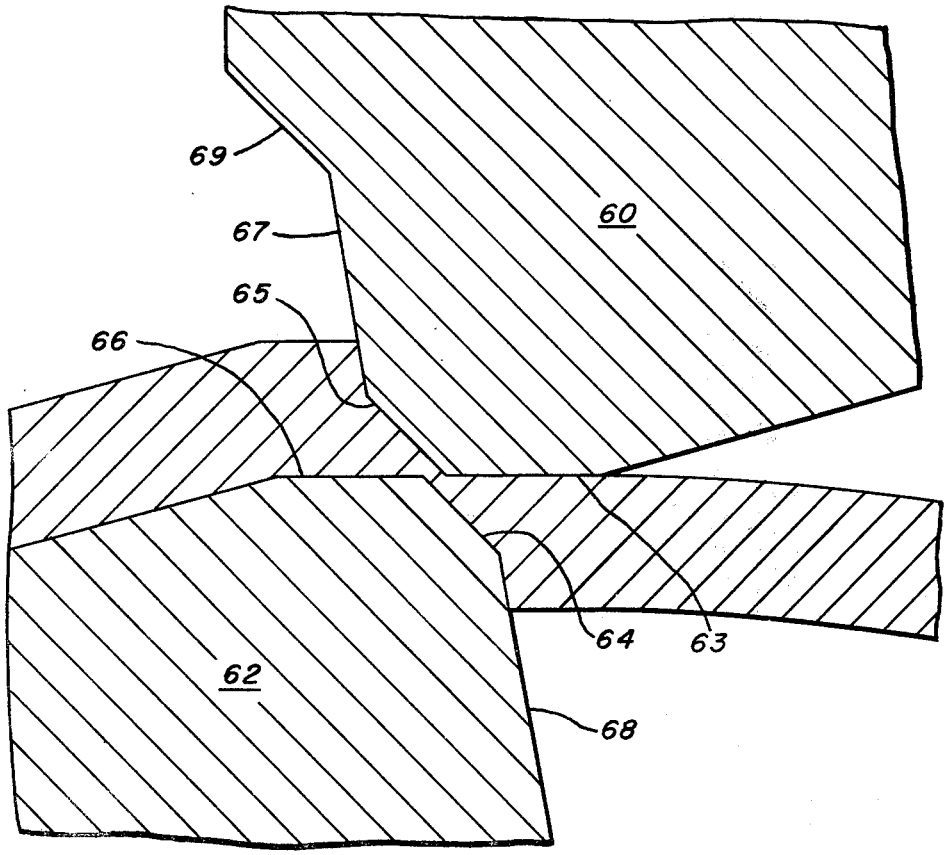
FIGS. 5, 6, 7 and 8 are enlarged fragmentary cross sections similar to FIG. 4 showing exemplary alternative tool shapes that can be used in the practice of this invention.
Figure 6:
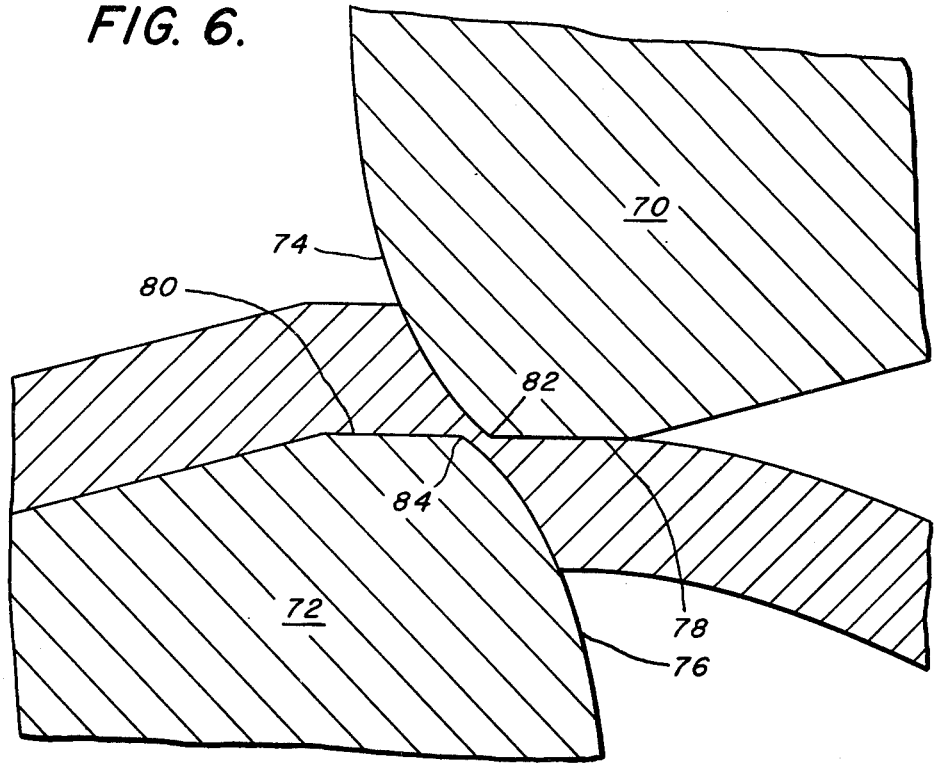

FIGS. 5 and 6 illustrate alternative embodiments of dies which can be used to form a weakening line or score in a sheet of metal or other deformable material in accordance with this invention. Coining dies such as the one illustrated in FIGS. 3 and 4 are preferably used with the dies illustrated in FIGS. 5 and 6, but are not illustrated. Dies 60 and 62 which are illustrated in FIG. 5 include faces 63, 64, 65 and 66 which are similar to like faces of the dies in FIGS. 3 and 4. The dies further include faces 67 and 68 which are disposed at approximately a 10° angle to vertical, and a face 69 on die 60 which is disposed at approximately a 45° angle to a horizontal plane. Face 69 is spaced a substantial distance above faces 63 on die 60 and permits free flow of metal in the area between the weakening line and the zone of coining.

Dies 70 and 72 illustrated in FIG. 6 include faces 74 and 76 which are curved away from faces 78 and 80. It will be appreciated by those skilled in the art that various other die shapes could also be employed for forming weakening lines in accordance with this invention. For example, small radii could be provided on corners 82 and 84 on dies 70 and 72, or on like corners of the dies illustrated in FIGS. 4 and 5.

Figure 7:
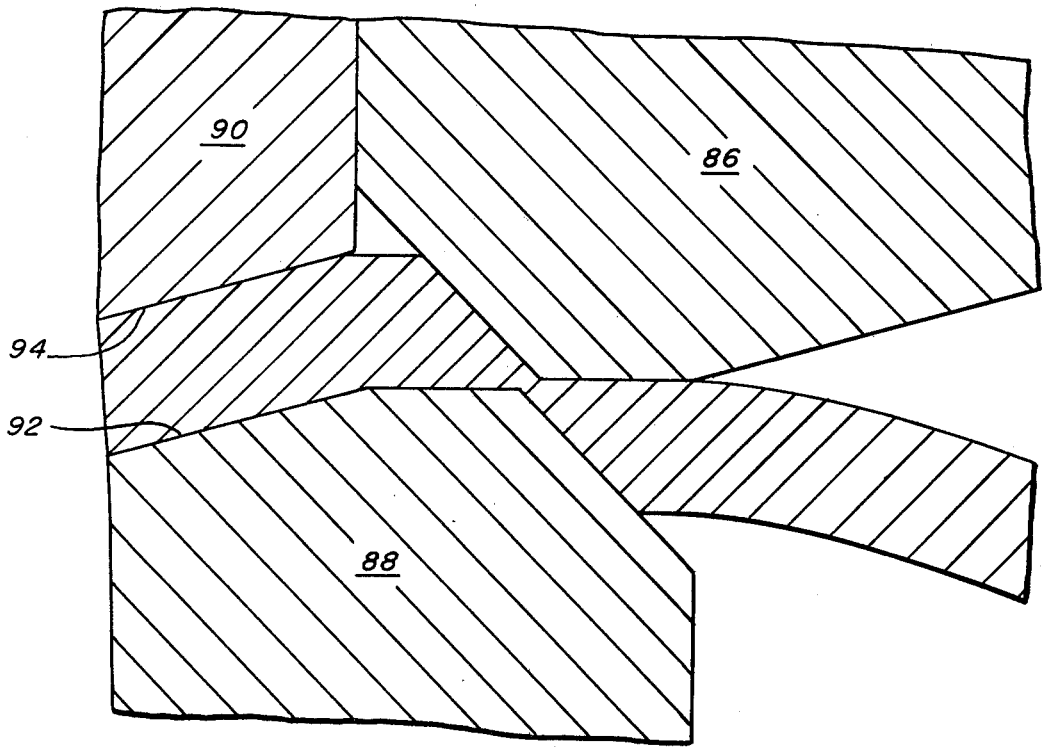

FIG. 7 illustrates another alternative form of tools which can be used in the practice of this invention, including top and bottom dies 86 and 88 for forming a weakening line in a metal sheet and a shaping die 90 for working metal adjacent the weakening line which is formed. Die 90 has a substantially flat bottom face 94 which may be parallel to face 92 on die 88. Faces 92 and 94 are disposed at approximately a 15° angle to the horizontal plane of the initially undisplaced surface of sheet 88 so that the metal therebetween will be formed at a similar angle. Dies 86 and 90 are shown as two separate dies, but they may also be made as a unit. In the closed position of die 86, 88 and 90, die surface 92 and 94 are preferably spaced a distance approximately equal to the thickness of the sheet being scored. However, dies 88 and 90 may also be closed against the sheet to squeeze the metal between faces 92 and 94. Additionally, die surfaces 92 and 94 may be more closely spaced distal the weakening line which is to be formed so that when the dies are closed, the sheet will be squeezed or extruded between such die surfaces toward the weakening line. Such squeezing or coining of the metal is believed to control the stresses which are produced in the metal so that a weakening line can be formed in metal sheet material having thicknesses which vary from nominal gauge.

Figure 8:
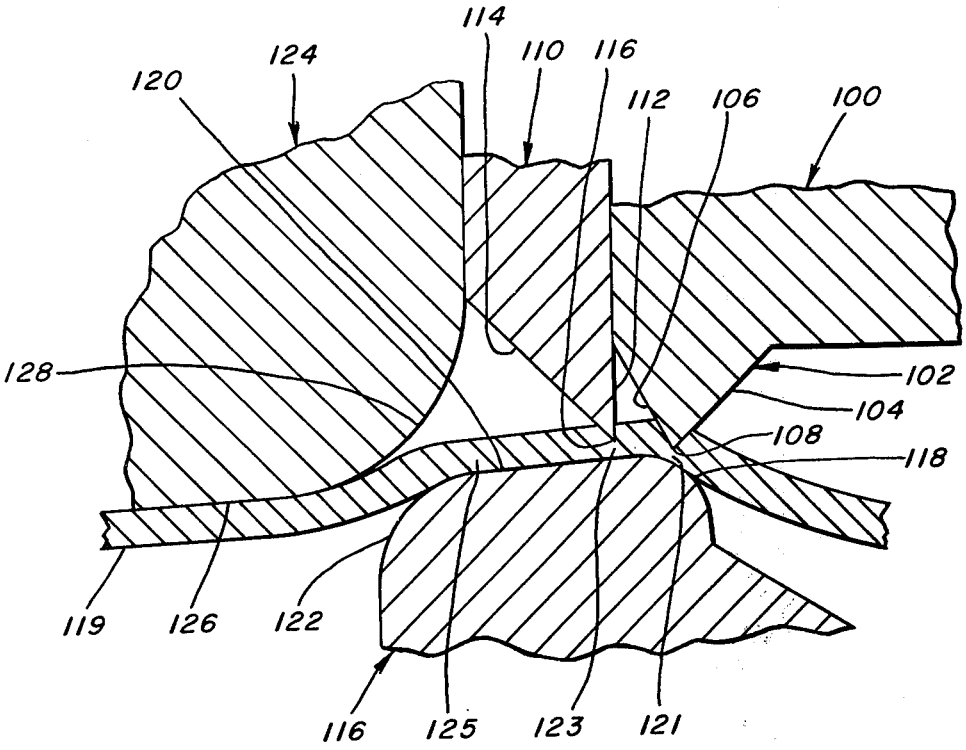

FIG. 8 illustrates another alternative embodiment of tools which can be used in the practice of this invention. This embodiment includes a first die member 100 having an indentor or rib 102 thereon with a first substantially planar metal working surface 104 and a second and angularly disposed substantially planar metal working surface 106 defining with the first surface 104 a corner 108 at the locus of intersection between such surfaces. The included angle between surfaces 104 and 106 may be in a range of approximately 45° to 90° and preferably about 75°. The corner 108 on indentor 102 is preferably essentially sharp as may be provided by merely deburring after the surfaces 104 and 106 have been formed by grinding or the like. The first die member 100 further has a coining rib 110, either as an integral part thereof or as a separate member, with the coining rib having a first substantially planar vertical surface 112 and a second substantially planar angularly disposed surface 114 defining a corner 116 at the locus of intersection therebetween. Corner 114 is preferably rounded as with a radius of approximately 0.001 inch. The included angle between surfaces 112 and 114 may, for example, be approximately 45°.

A second die member or anvil 116 is provided which has a metal supporting surface comprising a first rounded corner 118 opposing the indentor 102, a generally planar surface portion 120 opposing the coining rib and a second rounded corner 122 laterally spaced from the first rounded corner 118 by the generally planar surface 120. The first rounded corner 118 has a radius of curvature, for example, of approximately 0.020 inch, and the second corner 122 has a radius, for example, of approximately 0.030 inch. The tools further include an auxiliary die means 124 with a base surface 126 and a rounded corner 128 thereon which may be generally on the opposite side of the container wall from the second rounded corner 122 on the second die member 116, or may be laterally spaced from such rounded corner 122 so long as surfaces are adapted to assist in the formation of a deflectable corner in the container wall as is illustrated.

The first die member 100, coining rib 110 and auxiliary die means 124 are adapted to be lineally displaced toward the second die member 116 to selectively move the first and second surfaces 104 and 106 of the first die member into operative proximity with the metal supporting surface, and in particular the first rounded corner 118, of the second die member to engage a sheet metal container wall 119 therebetween and laterally displace portions of the sheet metal as the corner 108 on the first die member penetrates the sheet to form a weakening line which has a fracturable web of residual metal 121 therein. The coining rib 110 also engages the sheet of metal and coins it along a zone 123 adjacent to the fracturable web to facilitate forming the weakening line and fracturable web in sheet metal having varying thicknesses. Movement of the auxiliary die 124 toward the second die member forms a deflectable portion 125 in the sheet metal container wall by the conjoint action of the auxiliary die member and the metal supporting surfaces on the second die member. The die travel of the first die member is stopped when the corner 108 of indentor 102 has penetrated the sheet to within approximately 0.002 to 0.004 inch of the supporting surface of the second die member 116 to leave a fracturable web of residual metal of like thickness. The travel of the auxiliary die means is stopped when the base surface is in a predetermined longitudinally offset relation with the supporting surface 120 on the second die member to form an outwardly projecting deflectable portion which projects in a range of approximately 0.010 to 0.040 inch above the outer or public surface of the metal sheet around such deflectable portion. The container opening device which is thus formed may be opened by digitally pressing against the deflectable portion 125 to deflect it inwardly and thereby strain the fracturable web and initiate fracture thereof to permit inward displacement of a partially separated opening panel.

As described above, this invention provides a method and apparatus for forming a sheet metal container wall having at least one inwardly displaceable opening panel and an outwardly projecting deflectable portion disposed in integral interconnected relation with the opening panel by a selectively shaped, residually stressed, fracturable web. To form such container wall, a sheet of metal, preferably work hardened aluminum alloy, is introduced between a first die member and a second die member, whereafter at least one of the die members is lineally displaced with respect to the other to deform the sheet of metal and form the fracturable web. One of such first and second die members, and preferably the first die member, has a coining bead on it adjacent the corner on such die member and extending substantially parallel thereto. The other die member has a supporting surface on it facing the coining bead on the first die member. Auxiliary die means is disposed on the same side of the sheet of metal as is the first die member and has a metal base surface facing the opposite general direction as does the metal supporting surface on the second die member and in laterally spaced relation therewith.

In the operation of the dies, the first die member is displaced lineally toward the second die member to selectively move the first and second surfaces of the first die member into operative proximity with the metal supporting surfaces of the second die member to engage the sheet of metal and displace or laterally extrude portions of the sheet within the locus of displacement thereof through the conjoint action of the die members to form a fracturable web. The coining bead on the first die member coins the sheet of metal against the supporting surface on the second die member along a zone adjacent and substantially parallel to the fracturable web. Such coining produces a zone of coining of reduced metal thickness adjacent the weakening line which is formed. The auxiliary die means is displaced lineally toward the second die member to selectively move the base surface of the auxiliary die means into predetermined longitudinally offset relation with the first surface of the second die member in the direction of die displacement to form the deflectable portion by the conjoint action of the auxiliary die means and the second die member. The lineal displacement of the auxiliary die means preferably occurs concurrently with the lineal displacement of the first die member.

The apparatus and method of this invention are particularly well adapted for forming an easy opening container wall in work hardened aluminum alloy sheet material which is approximately three-quarters hard. Such material provides the strength and rigidity which is desirable for ease of opening of the container wall.

Although preferred embodiments of this invention have been illustrated and described, it will be apparent to those skilled in the art that various modifications could be made in the container wall, method and tools without departing from the invention or the scope of the claims appended hereto. For example, the die used for coining or squeezing the metal along the weakening line need not be moved as a unit with the die used to form the weakening line. Instead, it is believed that the coining die could be closed against a can end and held against the metal as the scoring dies are moved against the can end. It will also be appreciated by those skilled in the art that this invention can be employed to form weakening or score lines of a variety of linear configurations in a variety of articles of deformable sheet material such as closures, can ends and the like.

I claim:

1. In the formation of a sheet metal container component having at least one substantially rigid inwardly displaceable opening panel comprising a minor portion of the container component and an outwardly projecting deflectable portion disposed in integral interconnected relation therewith by a fracturable web, the steps of:

introducing a sheet of metal intermediate a first die member having a first substantially planar metal working surface having the generally annular outline of an opening panel to be formed and a second and angularly disposed substantially planar metal working surface defining with said first surface a corner at the locus of intersection therebetween, and a coining rib adjacent said corner and extending substantially parallel thereto on the side thereof outwardly of the opening panel to be formed, and a second die member having metal supporting surfaces thereon opposing said first and second surfaces and said coining rib on said first die member, and with auxiliary die means disposed on the same side of the sheet as said first die member having a metal shaping base surface facing in a generally opposite direction from said metal supporting surfaces of said second die member and in laterally spaced relation therewith;

lineally displacing said first die member toward said second die member to selectively move said first and second surfaces of said first die member into operative proximity with said metal supporting surface of said second die member, and thereby engage said sheet to laterally displace portions of said sheet as said corner penetrates the sheet to form said fracturable web, coining said sheet between said coining rib and said supporting surface along a zone adjacent said fracturable web outwardly of the opening panel within the fracturable web, lineally displacing said auxiliary die means towards said second die member to selectively move said base surface thereof into predetermined longitudinally offset relation with said metal supporting surface of said second die member in the direction of die displacement to form said deflectable portion by the conjoint action of said base surface and said metal supporting surface, and stopping said die member displacement when said corner of said first die member has penetrated the sheet to within a few thousandths of an inch of said metal supporting surface of said second die member.

2. A method as set forth in claim 1 wherein said first die member and said auxiliary die means are lineally displaced against the upper surface of said container component to form a substantially planar upper surface on the rim of said opening panel which is substantially coplanar with a substantially planar undersurface on the inner lip of said deflectable portion.

3. A method as set forth in claim 1 wherein a sheet of at least three-quarter hard temper aluminum alloy is introduced intermediate said first and second die members which are closed against said sheet.

4. A method as set forth in claim 1 wherein said sheet metal is thinned by said coining operation.

5. A method as set forth in claim 1 wherein the sheet material is substantially unrestrained in the area between which said weakening line is formed and the zone along which the sheet is coined.

6. Apparatus for forming a sheet metal container component having at least one substantially rigid inwardly displaceable opening panel comprising a minor portion of said container component and an outwardly projecting deflectable portion disposed in integral interconnected relation therewith by a fracturable web, comprising:

a first die member having a first substantially planar metal working surface having the generally annular outline of an opening panel to be formed and a second and angularly disposed substantially planar metal working surface defining therewith a corner at the locus of intersection therebetween, and a coining rib on said first die member adjacent said corner and extending substantially parallel thereto on the side thereof outwardly of the opening panel to be formed, a second die member having metal supporting surfaces thereon opposing said first and second surfaces and said coining rib on said first die member, and auxiliary die means having a metal shaping base surface facing in a generally opposite direction from said metal supporting surfaces of said second die member and disposed in laterally spaced relation therewith, said first die member and said auxiliary die means being lineally displaceable relative to said second die member with said first and second surfaces of said first die member in generally opposed relation with said metal supporting surfaces of said second die member, whereby displacement of said die members and said auxiliary die means against a sheet of metal positioned therebetween to a closed die position in which said corner of said first die member is disposed within a few thousandths of an inch of said metal supporting surface of said second die member and said base surface of said auxiliary die means is in longitudinally offset relation with said metal supporting surface of said second die member in the direction of die displacement will laterally extrude portions of said sheet within the locus of displacement thereof through the conjoint action of said first and second surfaces of said first die member and said metal supporting surface of said second die member to form said fracturable web, will coin or squeeze portions of said sheet between said coining rib and said metal supporting surface along a zone adjacent said fracturable web, and will form said deflectable portion by the conjoint action of said metal supporting surface of said second die and said base surface of said auxiliary die means.

7. Apparatus as set forth in claim 6 in which said coining rib has a substantially arcuate cross section.

8. Apparatus as set forth; in claim 6 in which said metal supporting surfaces of said second die member include first substantially planar base surface and a second and angularly disposed substantially planar metal extruding surface defining an obtuse corner at the locus of intersection therebetween, and said first die member is adapted to be lineally displaced with said first and second surfaces thereon in generally opposed relation with said second and first surfaces respectively of said second die member.

* * * * *